US006378146B1

(12) United States Patent
Johnston

(10) Patent No.: US 6,378,146 B1
(45) Date of Patent: Apr. 30, 2002

(54) SPA AND SHOWER COMBINATION

(76) Inventor: William R. Johnston, 1611 Tamarind, Montara, CA (US) 94037

( * ) Notice: Subject to any disclaimer, the term of this patent is extended or adjusted under 35 U.S.C. 154(b) by 0 days.

(21) Appl. No.: 09/599,473

(22) Filed: Jun. 22, 2000

(51) Int. Cl.[7] ..... A47K 3/00
(52) U.S. Cl. ..... 4/541.1; 4/615
(58) Field of Search ..... 4/541.1, 541.3, 4/541.4, 567, 568, 569, 570, 615, 492

(56) References Cited

U.S. PATENT DOCUMENTS 2,772,421 A * 12/1956 Friend ..... 4/541.3
3,407,411 A * 10/1968 Stevens ..... 4/570 X
3,717,142 A * 2/1973 Mickelson ..... 4/570 X
3,831,593 A * 8/1974 Ochoa ..... 4/541.3 X
4,307,714 A * 12/1981 Weideman ..... 4/567 X
5,608,927 A * 3/1997 Lowry et al. ..... 4/615

* cited by examiner

*Primary Examiner*—Robert M. Fetsuga
(74) *Attorney, Agent, or Firm*—Burns, Doane, Swecker & Mathis L.L.P.

(57) ABSTRACT

A spa and shower combination includes a tub, a pump assembly, a coupling, a shower conduit attached to the coupling and a showerhead. The tub has an interior and an exterior. The combination includes a frame for supporting the showerhead. The frame supports the shower head external to the tub to allow spa users to conveniently shower prior to using the spa. The shower drains external to the tub to keep the spa water clean. The coupling, according to one aspect of the invention, is in fluid communication with the pump assembly and is removeably attached to the exterior of the tub. The coupling, in accordance to another aspect of the invention removeably connects directly with a spa nozzle within the tub.

11 Claims, 4 Drawing Sheets

SPA AND SHOWER COMBINATION

FIELD OF THE INVENTION

The present invention pertains to spa tubs and the like, more particularly, the present invention pertains to spas having a pressurized shower head attachment.

BACKGROUND OF THE INVENTION

Spas are known by many names including hot tubs, Jacuzzis, whirlpools, etc. Generally speaking a spa is a tub for bathing and relaxing. A typical spa includes a water heater, pump assembly, conduit system and water jets that are powered by the water pump. The water jets typically direct warm water into the spa to massage a spa user, to circulate water, and to generate bubbles.

An oft-voiced drawback of spas is maintenance. A spa owner must periodically drain the spa, add chemicals to the water, and clean the spa. Public spas, and public swimming pools, typically require a bather to shower before entering the water. Showering before bathing in a spa reduces the amount of dirt and oils carried into the spa by the bather. This reduces the maintenance burden on the spa cleaner.

Privately owned spas such as those in a homeowner's back yard, however, are not typically equipped with a shower in proximity to the spa. Spas located in condominium and apartment complexes may, or may not, include a nearby shower. Many homeowners, condominium residents and apartment tenants are hesitant to take a shower, dry off, walk through the home, or apartment complex, and then jump into the spa. Accordingly, what is desired is a way to bathe spa users, which is convenient and does not require a long trek to the spa. What is also desired is a low maintenance spa.

SUMMARY OF THE INVENTION

A spa and shower combination includes a tub with a pump assembly with nozzles for delivering water into the tub. The invention also includes a shower assembly including a frame, a showerhead, coupling, and a conduit for delivering water to the showerhead. The frame supports the showerhead.

The frame supports the shower head external to the tub to allow spa users to conveniently shower outside of the spa prior to using the spa. The shower drains external to the tub to keep the spa water clean. This configuration makes showering convenient and thereby minimizes spa maintenance.

The coupling feeds water from the pump assembly through the shower conduit and the showerhead. According to one aspect of the invention the tub has an exterior and the coupling removeably attaches to the exterior of the tub. The coupling, in accordance to another aspect of the invention removeably connects directly with a nozzle within the tub. The pump assembly includes a pump and pipes that deliver water to the nozzles, which are integrated into the interior of the tub. It can be appreciated that should a more permanent attachment of the shower assembly be desired, the coupling can be integrated into the pump assembly and be affixed under the tub on the pump.

Preferably the tub mounts on a deck. The frame for the showerhead, according to one aspect of the invention, is free standing to be moveable on the deck to a convenient location such as a location where shower water will properly drain and not enter the tub. According to another aspect of the invention, the tub mounts on a deck, adjacent a wall. The frame mounts on the wall for long lasting durability. According to another aspect of the invention, the frame mounts directly to the exterior of the tub and directs the showerhead away from the tub. Preferably, the frame includes a telescoping extension for adjustably positioning the showerhead.

DETAILED DESCRIPTION

Figure 1:
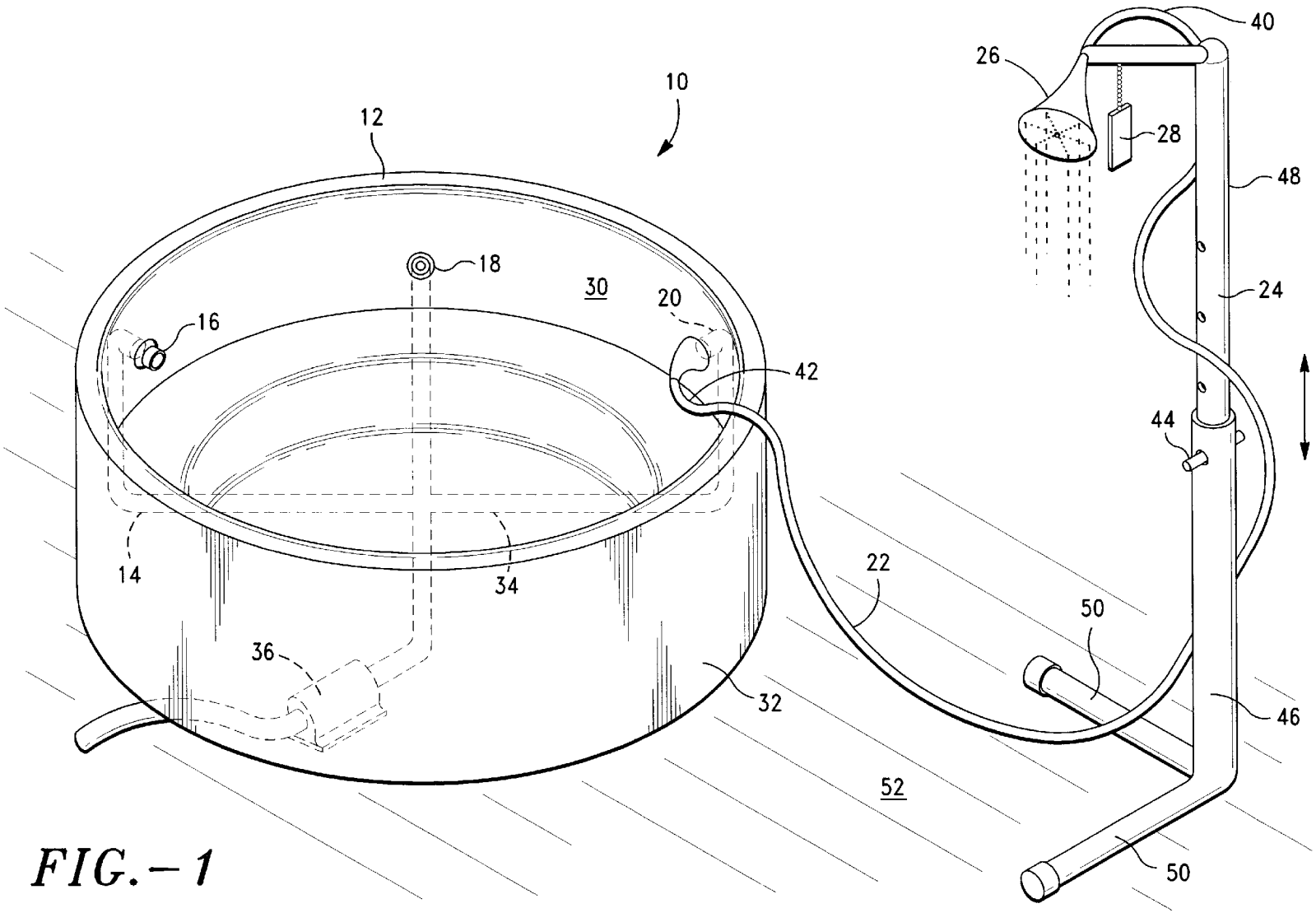
FIG. 1 shows a spa with a freestanding shower.

FIG. 1 shows a spa and shower combination generally designated with the reference numeral 10. The spa includes a tub 12, a pump assembly 14 with nozzles 16, 18 and 20, and a shower assembly having a shower conduit 22, a frame 24, a showerhead 26 and a valve 28. The tub 12 has an interior 30 for holding water and an exterior 32.

The pump assembly 14 includes a pump 36 and pipes 34 that interconnect the pump 36 with the nozzles 16, 18 and 20, respectively. The pump assembly 14 pumps water into the tub via the nozzles 16, 18 and 20. The nozzles 16, 18 and 20 are integrated with the tub 12. Accordingly, the pump assembly 14 pressurizes water and forces the pressurized water through the nozzles 16, 18 and 20 for directing water into tub 12.

The conduit 22 is flexible and has a first end 40 and a second end 42, the first end 40 includes the shower head 26 and the valve 28. The valve 28 is integrated with the showerhead 26 according to one aspect of the invention. In accordance with an alternate aspect of the invention, the valve 28 is integrated with the conduit 22, at either the first end 40 or the second end 42.

The conduit 22 includes a connector attached to the second end 42 for removeably coupling the second end 42 of the conduit to the nozzle 20. The valve 28 selectively regulates water flow from the showerhead 26.

The frame 24 is a free standing tubular device having a lock 44 and two sections 46 and 48 that telescope with respect to each other to adjustably position the showerhead 26. The frame 24 is positioned exterior to the tub 12 for holding the showerhead 26 outside of the tub 12. Holding the showerhead 26 outside of the tub 12 allows a spa user to shower next to the tub 12 prior to spa 10 use. The showerhead 26 water drains away from the tub 12, keeping the tub 12 water clean. This makes tub 12 maintenance less frequent, and less burdensome. Further, less chemical purifying agents may be required when spa 10 users shower before entering the spa 10.

According to one aspect of the invention, the frame 24 attaches to the exterior of the tub 12. The showerhead 26 directs the water away from the tub 12.

The spa 10 includes a wood deck 52. The tub 12 sits on the deck 52 and the frame 24 mounts on the deck 52. Preferably, the frame 24 has feet 50 that attach to the section 46. The feet 50 enable the frame 24 to be moveably mounted on the deck 52 in any desired position and orientation near the spa 10. When the spa 12 is partially empty and needs to be cleaned, the frame 24 can move the showerhead 26 to spray off the tub 12 to ease cleaning.

Figure 2:
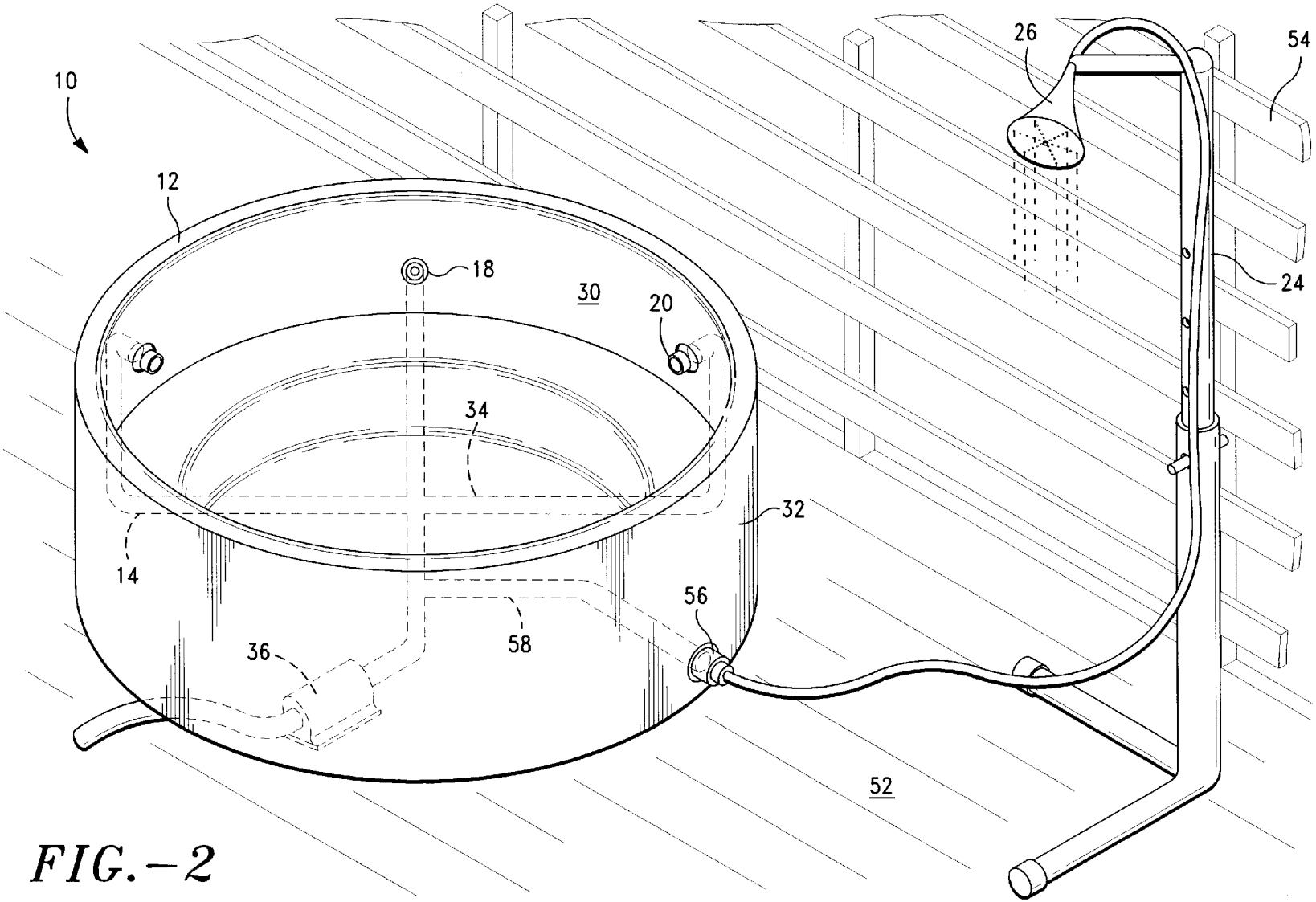
FIG. 2 shows a spa with an external coupling.

FIG. 2 shows the spa 10 with a deck 52 and a wall 54. The wall 54 is adjacent the tub 12. The frame 24 mounts on the wall 54 and directs water from the showerhead 26 on to the deck 52.

The pump assembly includes a coupling 56 mounted on the exterior 32 of the tub 12 and in fluid communication with the pump assembly 14. The pump assembly 14 includes a valve 58 positioned between the coupling 56 and the pump 36 to regulate the pressure and rate of water flowing to the conduit 22. Accordingly, the coupling 56 is selectively useable. It can be appreciated that connecting the conduit 22 to the pump 36 may result in a high-pressure shower.

Figure 3:
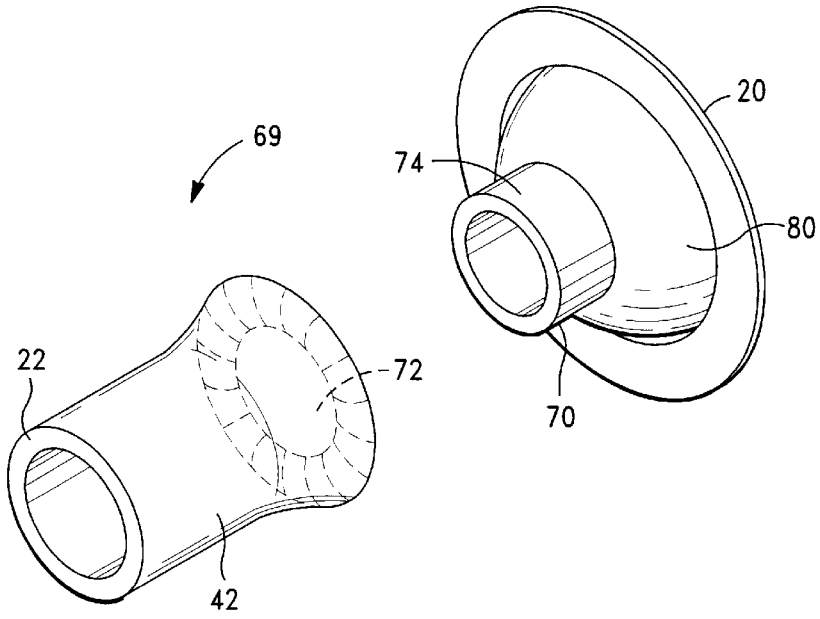
FIG. 3 shows a conduit having a flared end.

FIG. 3 shows the nozzle 20 and the conduit 22 having a connector 69. The nozzle is multi directional having a spout 70 with an external periphery 74. The second end 42 of the conduit 22 has an inner periphery 72 that press fits around the external periphery 74 of the spout 70 to connect the conduit 22 and the nozzle 20. Accordingly, the conduit 22 is removeably from the spout 70 without a need for tools.

Figure 4:
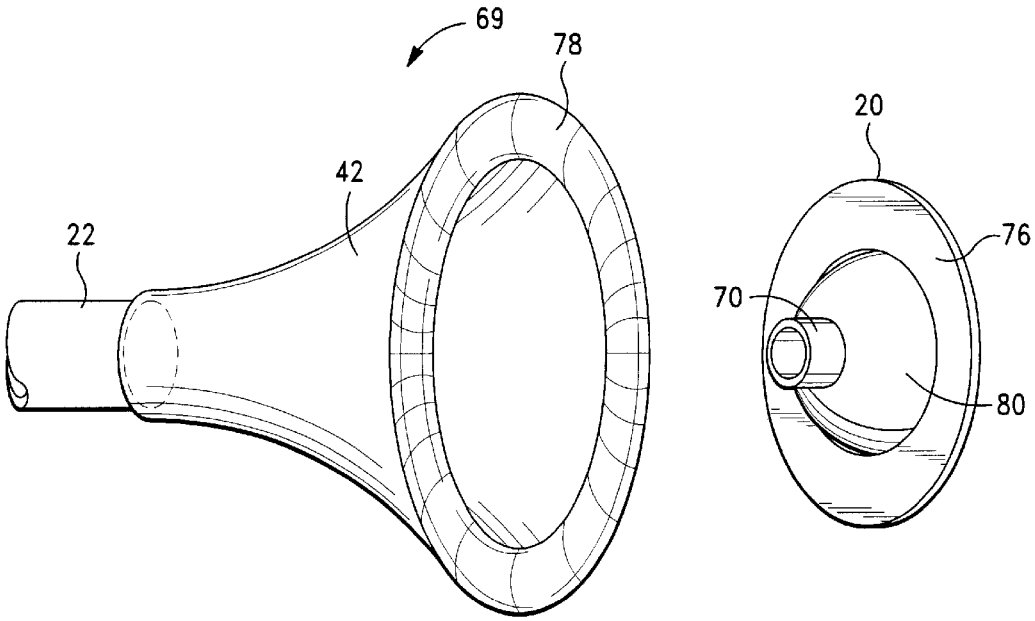
FIG. 4 shows a conduit having a flared end with concave rim.

FIG. 4 shows the nozzle 20 having an annular plate 76. The annular plate 76 surrounds the spout 70. The connector 69 attaches to the end 42 of the conduit 22. The connector 69 is flared to surround the spout 70. The connector 69 includes a concave rim 78 that functions as a suction cup. The rim 78 engages the annular plate 76 to hold the connector 69 over the nozzle 20 and the spout 70.

The spout 70 rotates with respect to the plate 76 of the nozzle 20 to enable a user to direct water flow out from the nozzle 20. This rotation makes connection of the connector 69 challenging to maintain. Attaching the concave rim 78 of the connector 69 to the rim of the spout eliminates problems associated with rotation of the spout 70.

According to one aspect of the invention, the nozzle 20 has a curved semispherical surface 80. The concave rim 78 mates with the curved surface 80.

Figure 5:
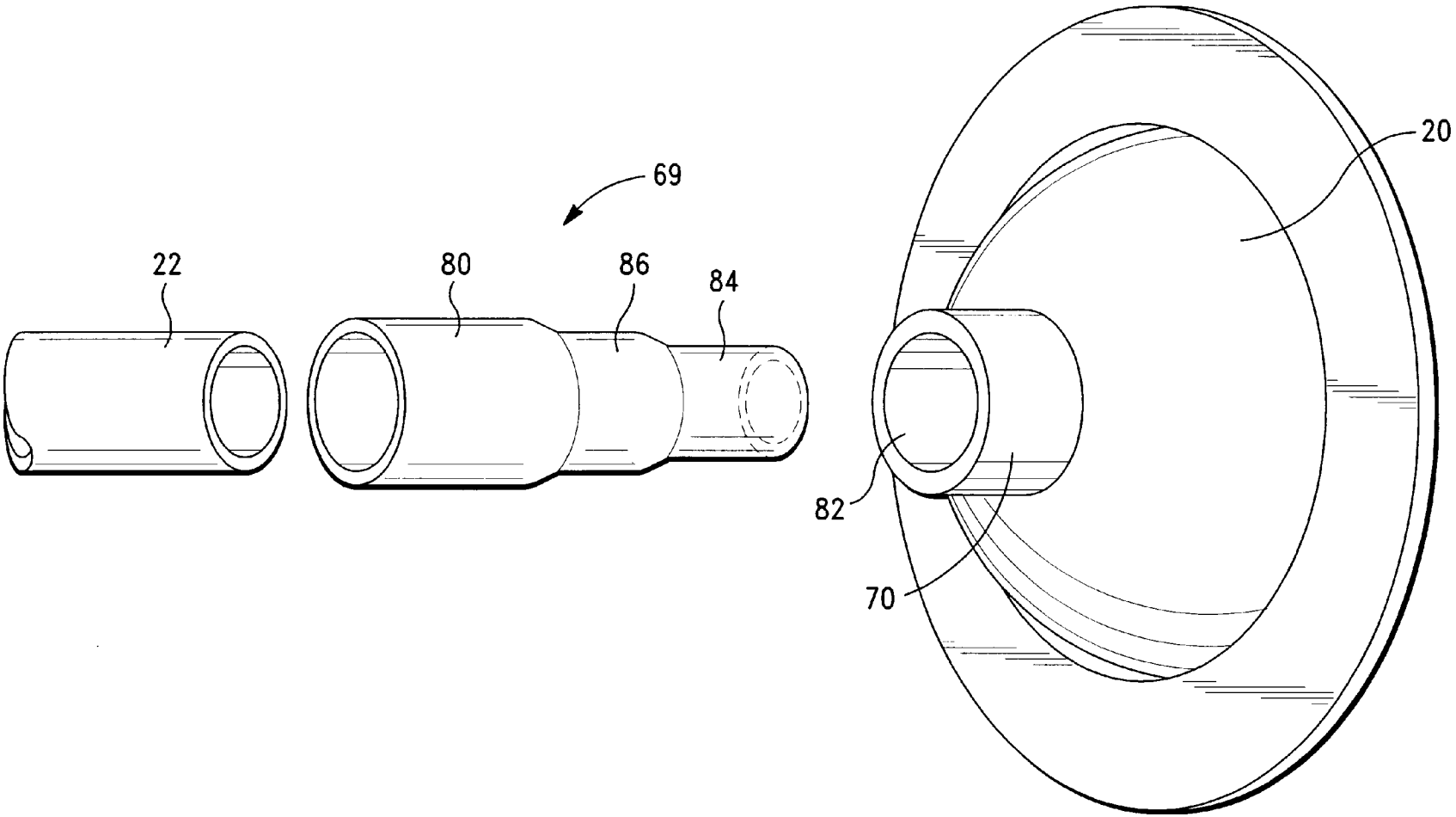
FIG. 5 shows a conduit having a stepped end for insertion into a spout.

FIG. 5 shows the connector 69 having a stepped adapter 80. The adapter 80 includes a narrow cylindrical surface 84 and a relatively wider cylindrical surface 86. The nozzle 70 includes a inner surface 82. The surfaces 84 and 86 enable the stepped adapter 80 to interconnect the connector 69 to spouts 70 of various sizes. Preferably the surface 84 inserts into the spout 70 and press fits against the inner surface 82. The surface 86 prevents further insertion.

The above description is by way of example only and is not intended to limit the invention. It can be appreciated that the connector 69 configuration can vary. The frame 24 may mount on the interior 30 or exterior 32 of the tub 12. Further the shower head 26 may be directed into the tub when, for example, a spa user wants warm water to shower over him or her. Accordingly, the invention is to be limited only by the appended claims.

What is claimed is:

1. A spa and shower combination, comprising:

a tub having an interior and an exterior;

a pump assembly for pumping water into the spa tub, the pump assembly including nozzles integrated within the interior of the tub, the pump assembly pressurizes water and forces the water through the nozzles for directing water into tub;

a coupling in fluid communication with the pump assembly and being attached to the exterior of the tub;

a conduit having a first end and a second end, the first end including a showerhead; and a frame positioned exterior to the tub for holding the showerhead outside of the tub.

2. A spa and shower combination as set forth in claim 1, wherein the frame attaches to the exterior of the tub and the showerhead directs water away from the tub.

3. A spa and shower combination as set forth in claim 1, wherein the frame has at least two sections that telescope with respect to each other to adjustably position the showerhead.

4. A spa and shower combination as set forth in claim 1, wherein the frame is free standing.

5. A spa and shower combination as set forth in claim 1, wherein the spa and shower combination includes a wall adjacent the tub, the frame mounts on the wall.

6. A spa and shower combination as set forth in claim 1, wherein the spa and shower combination includes a deck, the tub sits on the deck, the frame mounts on the deck.

7. A spa and shower combination as set forth in claim 1, wherein the frame has feet and at least two sections that telescope with respect to each other to adjustably position the showerhead, the feet support the frame and the showerhead mounts on the telescoping sections.

8. A spa and shower combination as set forth in claim 7, wherein the extension has an adjustable in length to adjust showerhead height.

9. A spa and shower combination as set forth in claim 1, wherein the showerhead includes a valve for selectively regulating the flow of water from the showerhead.

10. A spa and shower combination as set forth in claim 1, wherein the conduit has a connector attached to the second end of the conduit.

11. A spa and shower combination as set forth in claim 10, wherein the second end of the conduit is removable from the nozzle.

* * * * *